US007712400B2

(12) United States Patent
Baumuller et al.

(10) Patent No.: US 7,712,400 B2
(45) Date of Patent: May 11, 2010

(54) PRETENSIONING TOOL FOR AN ECCENTRIC TENSIONING DEVICE

(75) Inventors: Rainer Baumuller, Herzogenaurach (DE); Roland Arneth, Eggolsheim (DE); Niels Flamig, Hessdorf (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/759,998

(22) Filed: Jun. 8, 2007

(65) Prior Publication Data

US 2008/0302220 A1 Dec. 11, 2008

(51) Int. Cl.
*B25B 11/00* (2006.01)
*B25B 25/00* (2006.01)
*B25B 13/56* (2006.01)
*B25B 13/48* (2006.01)

(52) U.S. Cl. ..... 81/486; 81/176.15; 81/176.2; 81/176.1; 81/176.3

(58) Field of Classification Search ..... 81/486, 81/177.7, 119, 121.1, 176.1–176.3
See application file for complete search history.

(56) References Cited

U.S. PATENT DOCUMENTS 4,526,066 A * 7/1985 Steck ..... 81/486
6,000,302 A * 12/1999 Chiang ..... 81/177.8
2005/0145076 A1* 7/2005 Tuan-Mu ..... 81/63.2

FOREIGN PATENT DOCUMENTS

DE 4033777 A1 4/1992

* cited by examiner

*Primary Examiner*—Bryan R Muller
(74) *Attorney, Agent, or Firm*—Volpe and Koenig, P.C.

(57) ABSTRACT

A pretensioning tool is provided for an eccentric tensioning device, which is used for tensioning a power-transmission element constructed, for example, as a flat or toothed belt in a power-transmission drive. The tensioning tool has an engagement structure that can be coupled so that it is locked in rotation with a working eccentric from a front region facing away from the flange side of the eccentric tensioning device and a decoupling structure for implementing an axial displacement of the working eccentric relative to the bearing journal. In this way, it is possible to turn back the working eccentric by hand and with moderate hand forces against the tensioning moment applied by the torsion spring of the tensioning device into a mounting position and to secure the working eccentric in this mounting position through axial decoupling of this eccentric relative to a base plate device.

4 Claims, 3 Drawing Sheets

PRETENSIONING TOOL FOR AN ECCENTRIC TENSIONING DEVICE

BACKGROUND

The present invention relates to a pretensioning tool for an eccentric tensioning device, which is used as such for tensioning power-transmission means constructed, for example, as a flat belt or toothed belt in a power-transmission means drive.

In particular, the invention here relates to a pretensioning tool for an eccentric tensioning device, which is provided for integration into a power-transmission means drive of an internal combustion engine and which automatically guarantees a desired pretensioning of the power-transmission means through an adjustment moment generated on the side of a torsion spring device and which is prepared in a pretensioned state before installation in the internal combustion engine.

From DE 40 33 777 A1, an eccentric tensioning device for a power-transmission means drive is known. This conventional tensioning device, also designated as a double eccentric tensioning device, comprises an adjustment eccentric, which makes available a bore arranged eccentrically for receiving an attachment screw. By means of the attachment screw, the tensioning device is mounted on a housing, especially a housing of the internal combustion engine, wherein the adjustment eccentric is supported by means of a base plate on the housing. Placed on this adjustment eccentric is a working or operating eccentric, with there being a slide bearing in an annular gap between a casing surface of the adjustment eccentric and an inner wall of the operating eccentric. On the outside, a roller bearing surrounds the operating eccentric, whose outer ring functions directly as a free running disk, which sits as such in the installed state, i.e., in the operating state, on the power-transmission means of the power-transmission means drive and applies a force to this with a transverse force directed perpendicular to the running direction. For achieving a non-positive contact of the running disk on the power-transmission means, between the base plate and the operating eccentric there is a torsion spring, which forces the operating eccentric and the running disk connected to this operating eccentric continuously into a position tensioning the power-transmission means.

SUMMARY

The invention is based on the objective of creating solutions, through which advantages are produced in the installation of power-transmission means tensioning devices, which can be secured as such in a mounting state under pretensioning of the torsion spring.

This objective is achieved according to the invention by a tensioning tool for an eccentric tensioning device of a power-transmission means drive, which comprises a working eccentric loaded by a torsion spring, a bearing journal supporting the working eccentric, and a running disk device encompassing the working eccentric, with the tool having:

- An engagement structure that can be coupled locked in rotation with the working eccentric from a front region facing away from a flange side of the eccentric tensioning device, and
- A decoupling structure for implementing an axial displacement of the working eccentric relative to the bearing journal.

Therefore, advantageously it is possible in an eccentric tensioning device of the type named above to turn back the working eccentric by hand and with moderate hand forces against a tensioning moment applied by the torsion spring of the tensioning device and to secure the working eccentric in this mounting position through axial decoupling of this working eccentric relative to a base plate device.

Bringing the eccentric tensioning device into the secured state can be achieved here by setting the mounting tool according to the invention on the front, i.e., on the end facing away from a flange side of the eccentric tensioning device, such that the engagement structure projects into the engagement recess formed on the side of the working eccentric. Then the tensioning tool according to the invention is turned against the tensioning moment generated by the torsion spring device. Through the accompanying or resulting axial displacement of the working eccentric relative to the base plate structure, the eccentric tensioning device is secured in the pretensioned state and thus reconfigured.

According to an especially preferred embodiment of the invention, the engagement structure for engaging with the working eccentric is formed by a prism-shaped pin. This prism-shaped pin can be produced, in particular, as a hexagonal-socket pin with a hexagonal cross section or also as a polygonal pin, especially with a TORX-shaped cross section. The recess for receiving this engagement structure on the working eccentric is preferably constructed as a bore, especially a pocket bore, which is complementary to the cross section of the engagement structure. This pocket bore is preferably located at a peripheral position of the working eccentric, at which this has a sufficiently large, preferably maximum wall thickness.

The tensioning tool according to the invention is preferably constructed so that this comprises a gripping device, with the engagement structure preferably being coupled with the gripping device in an articulated way, such that the gripping device can pivot relative to the engagement structure about a pivot axis that extends perpendicular to the rotation axis of the working eccentric.

The decoupling structure formed on the tensioning tool according to the invention can be shaped so that this comprises at least one pressure spindle, which can be lowered onto an end face of the bearing journal of the eccentric tensioning device. This pressure spindle is preferably dimensioned so that this can pass through a bore formed in the end region of the eccentric tensioning device with sufficiently large motion play.

On the tensioning tool according to the invention, especially the decoupling structure of this tool, a hook section can also be formed, which as such can be brought into engagement with a peripheral connecting section of the running disk device. The entire tensioning tool can be constructed such that the articulated, prism-shaped pin is located essentially centrally in an intermediate region between the pressure spindle and the hook section of the decoupling structure.

The tensioning tool according to the invention is preferably produced from a high-strength material, especially steel. In the area of the contact surfaces in contact with the eccentric tensioning device, it is possible to provide the tool with a coating, which prevents deterioration of the surface quality of the tensioning device, especially scratching of this device.

BRIEF DESCRIPTION OF THE DRAWINGS

Additional details and features of the invention emerge from the following description in connection with the drawing. Shown are.

DETAILED DESCRIPTION OF THE PREFERRED EMBODIMENTS

Figure 1:
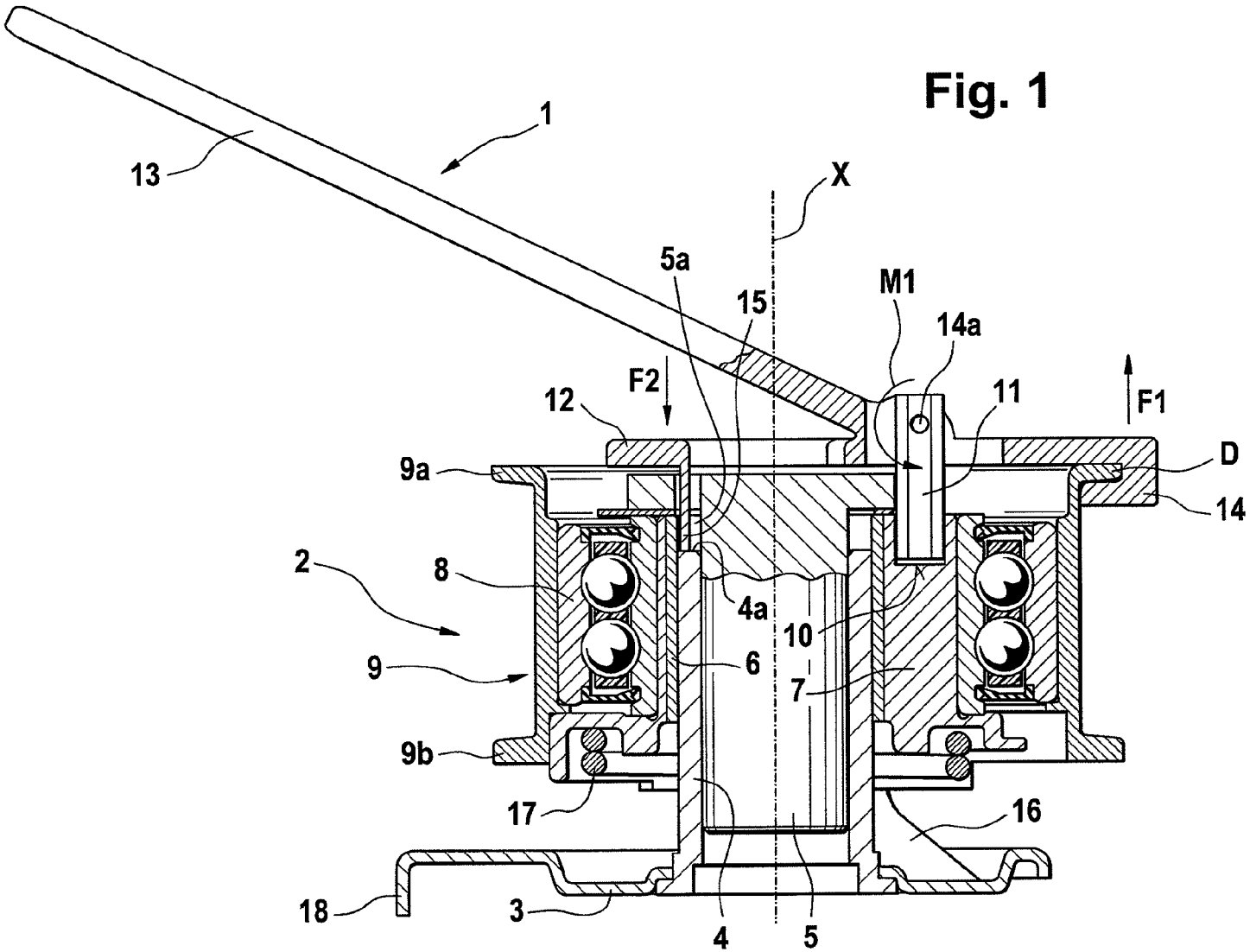
FIG. 1 an axial section view for illustrating the setup and engagement of a tensioning tool according to the invention on a special eccentric tensioning device that can be secured in a pretensioning position, FIG. 2 a perspective view for further illustrating the setup of the tensioning tool set on the tensioning device according to FIG. 1, FIG. 3 a perspective view of another embodiment of a tensioning tool according to the invention.

FIG. 1 shows a tensioning tool 1 according to the invention, which is set as such on an eccentric tensioning device 2 that can be secured in a pretensioning position. The eccentric tensioning device 2 comprises a base plate 3, a bearing journal 4 constructed here as a hollow journal, an adjustment eccentric 5 inserted into the bearing journal 4, a slide bearing bushing 6, and a working eccentric 7 sitting on the slide bearing bushing 6. A roller bearing device 8, which is constructed as a double-row ball bearing and which, as such, carries a running disk device 9 provided with a peripheral connecting piece 9*a*, 9*b* on both sides, sits on the working eccentric 7. An engagement recess 10 constructed as a pocket hole within the region that can be seen here to have a relatively large radial wall thickness is formed in the working eccentric 7. This engagement recess 10 has a polygonal cross section constructed, in particular, as a hexagonal bore.

The tensioning tool 1 according to the invention set on the eccentric tensioning device described above comprises an engagement structure 11 constructed as a prism-shaped pin and a decoupling structure 12. In the embodiment shown here, the engagement structure 11 is constructed as a prism-shaped pin with a hexagonal cross section. The receptacle recess formed in the working eccentric 7 has a bore cross section that is complementary to the outer cross section of the prism-shaped pin 11, so that the prism-shaped pin 11 is anchored locked in rotation in the engaged position shown here in the recess 10 of the working eccentric 7.

The tensioning tool 1 comprises a gripping device 13, which is constructed like a type of wrench shaft and on whose foot end facing the eccentric tensioning device in the functional position a prism-shaped pin acting as the engagement structure 11 is pivatably connected by a hinge pin 14 so that it can pivot. The pivoting axis defined by the hinge pin 14 runs transverse to the rotation axis X of the working eccentric 7.

The decoupling structure of the tensioning tool 1 shown here further comprises a hook section 14, which as such can be brought into engagement with a peripheral connecting piece 9*a* of the running disk 9. On the decoupling structure 12 there is further a pressure spindle 15, which can pass through an opening 5*a* formed in the adjustment eccentric 5 and which here can be set on a front annular end face 4*a* of the bearing journal 4. By means of the hook section 14 and the pressure pin 15, it becomes possible to construct a system of forces, through which the working eccentric 7 can be shifted together with the running disk device sitting on this eccentric in the axial direction relative to the bearing journal 4 and the base plate device 3. Through this axial shifting of the working eccentric 7, it becomes possible to bring a fixing structure 16 constructed on the base plate device 3 into engagement with an engagement structure of the working eccentric 7 that cannot be seen in more detail in this representation and to fix the working eccentric 7 in a mounting position tensioned against a restoring force of the torsion spring device 17.

The twisting of the base plate device 3 is prevented by a catch structure constructed here as projection 18 formed on the base plate device 3. When the eccentric tensioning device shown here is used as a belt tensioner of an internal combustion engine, this catch structure typically sits in a catch recess formed on the side of the engine block or the cylinder head in a corresponding flange surface.

In the position shown here, the eccentric tensioning device is already located in a reconfigured or mounting state achieved through the use of the tensioning tool according to the invention. The pressure spindle 15 is completely lowered into the passage recess 5*a*. This lowering is realized by tilting the decoupling structure 12 about a center of rotation defined by the hook section 14. The indicated force F1 decoupling the working eccentric 7 in the axial direction is applied to this center of rotation. The counter force F2 generated here is introduced via the pressure spindle 15 into the end face of the bearing journal 4. This force pair F1, F2 can be generated in an ergonomically advantageous way through one-handed gripping of the shaft 13 and tilting of this shaft relative to the flange surface.

Figure 2:
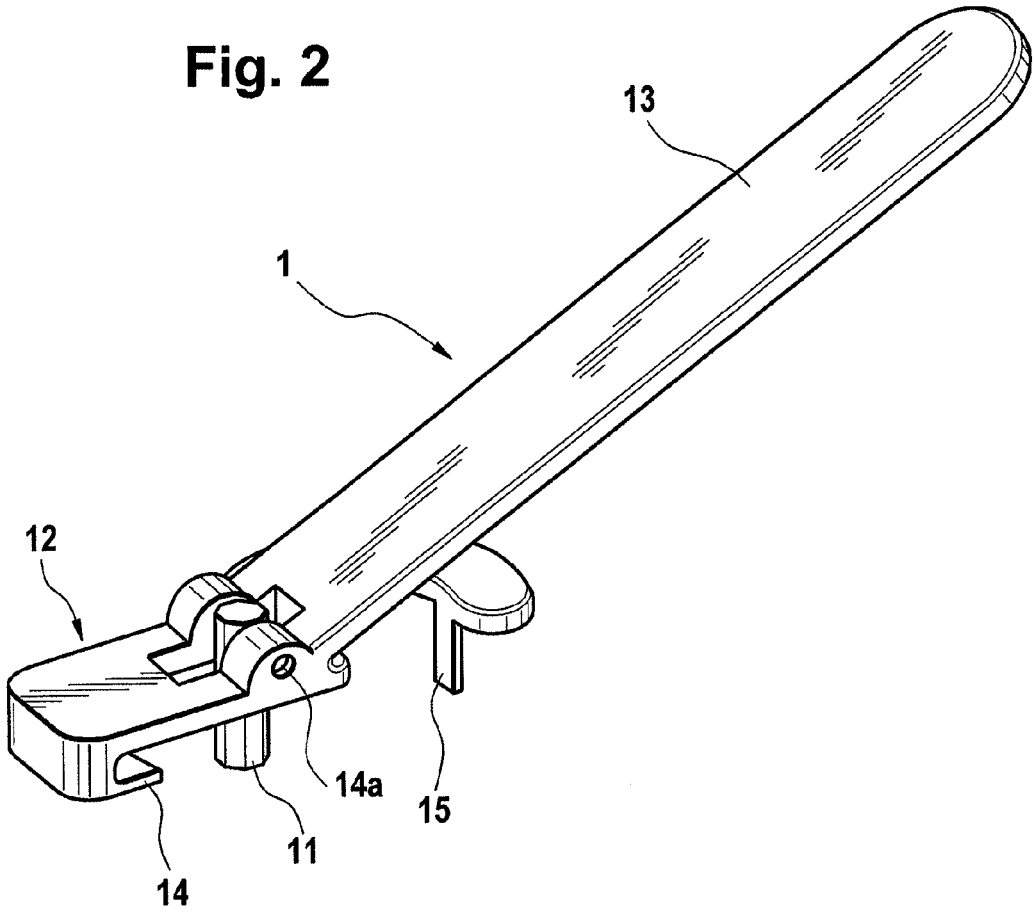

From FIG. 2, the setup of the tensioning tool according to the invention is even further visible. The tensioning tool 1 according to the invention comprises, as can be seen, the gripping shaft 13, the decoupling structure 12, and the engagement structure 11. The decoupling structure 12 comprises the hook section 14 and the pressure spindle 15 that can be brought into engagement with the peripheral edge section of the running disk 9 (see FIG. 1).

The engagement structure 11 constructed as a prism-shaped pin is coupled with the decoupling structure 12 so that it can pivot about a hinge pin 14*a*.

The hook structure 14 is constructed so that motion play sufficient for inserting the pin 11 remains within the scope of placing this structure on the plate 9*a* of the running disk device 9 (see FIG. 1). Furthermore, the hook structure 14 is constructed so that tilting of the decoupling structure 12 is allowed about a center of rotation D lying in the edge region of the running disk. The hook structure 14 can wander slightly in the radial direction preferably during the tilting of the decoupling structure 12. The pin 11 can be constructed so that this is guided displaceably in the axial direction against a spring restoring force, so that this is inserted completely into the recess 10 even for an inclined placement of the decoupling structure 12.

Figure 3:
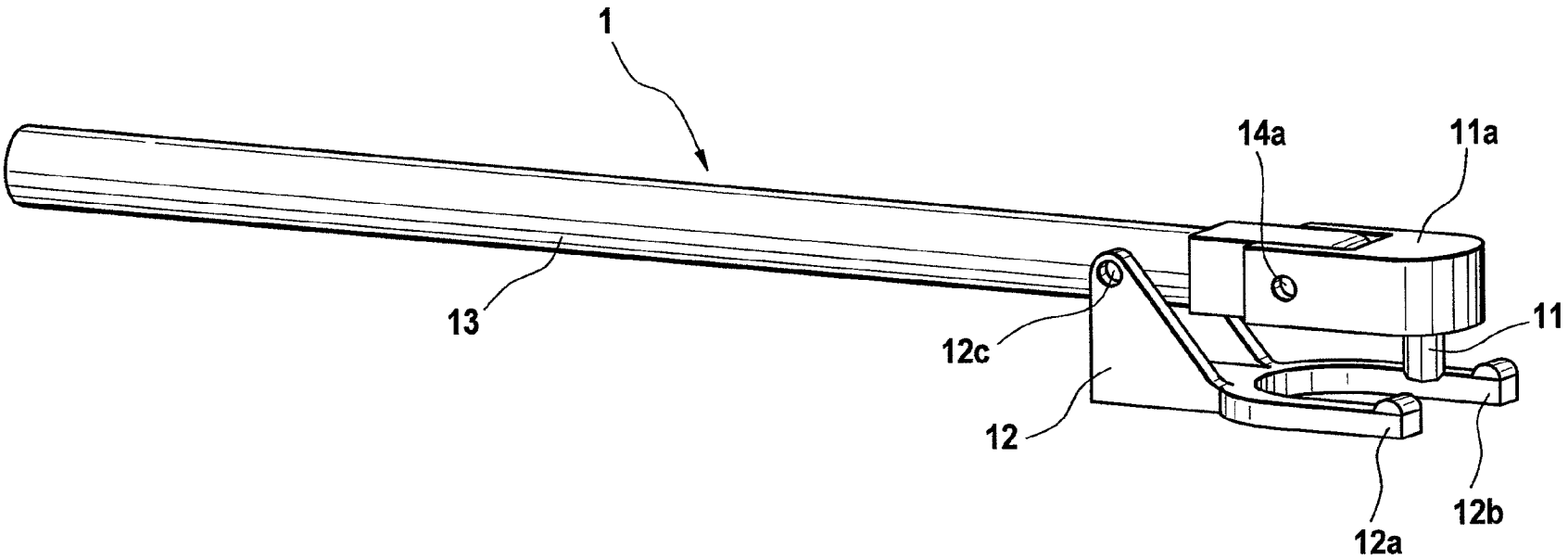

In FIG. 3, in the form of a perspective view, another variant of a tensioning tool 1 according to the invention is shown. This tensioning tool 1 also comprises a shaft 13 provided for manual handling, an engagement structure 11, and a decoupling structure 12. The decoupling structure 12 is shaped in this embodiment as a decoupling fork, which as such has two under-grip fork arms 12*a*, 12*b*, which can be inserted into an intermediate region between the running disk device 9 and the base plate device 3 (cf. FIG. 1) and thus allow decoupling of the working eccentric 7 from the unlocked position in the mounting position shown in FIG. 1. In the embodiment shown here, the engagement structure 11 is coupled with the shaft 13 so that it can pivot by means of a hinge head 11*a* and a pivot pin 14*a*. The decoupling structure 12, which is constructed here as a decoupling fork, is similarly coupled with the shaft 13 so that it can pivot by means of a pivot pin 12*a*. The shaft 13 is here constructed as a rod with an essentially circular cross section.

The tensioning tool according to the invention is used as such for bringing the toothed belt tensioning into a preassembled state typically corresponding to a replacement part delivery state. Through the tensioning tool according to the invention, both the introduction of a tensioning moment forcing the working eccentric of the tensioning device into the pretensioning pivoted position and also the bringing of the securing device into the locking position are implemented. Through the tool according to the invention, through positive-fit engagement, the tensioning moment necessary for creating pretensioning position is introduced into the working eccentric. This positive-fit connection can be achieved through the hexagonal socket or other polygonal geometry of the engagement element 11 described above. If the working eccentric is located in the mounting position, the working eccentric is shifted in the axial direction relative to the base plate device or the structure carrying the working eccentric in some other way, in particular, the bearing journal, by the decoupling mechanism integrated into the tensioning tool according to the invention. This shift sets the tensioning back into the delivery state, i.e., the working eccentric is again located in the mounting position. The lever mechanism of the pretensioning tool according to the invention is preferably constructed as follows:

If the working eccentric is located in the assembled position, a torque M1 is generated at the point of rotation a by means of the lever of the pretensioning tool. The force F1 generated by this moment pulls the working eccentric with the slide bearing away from the base plate by means of the running disk. The pin 15, which is located on the other side of the point of rotation a on the mounting tool, generates a counter force F2, through which a relative motion is caused between the pin 4 and the working eccentric 7. If the relative motion between the pin 4 and working eccentric 7 is applied, the working eccentric is again located in the delivery state and thus in the mounting position. The component of the tensioning tool that can be brought into engagement with the running disk 9 can be coated for protecting the running disk, especially covered with a plastic material.

The tensioning device and the tensioning tool can be adapted to each other so that within the scope of pivoting the working eccentric, the adjustment eccentric is also forced to move with this pivoting, so that both the working eccentric and also the adjustment eccentric are pivoted within the scope of using the mounting tool in a necessary mounting position. This joint movement can be realized, in particular, by forming a catch recess, in which the engagement structure of the tensioning tool can be inserted, in a plate of the adjustment eccentric.

The invention claimed is:

1. Tensioning tool for an eccentric tensioning device of a power-transmission element drive, which includes a working eccentric loaded by a torsion spring, the working eccentric having a front region and a flange side a bearing journal supporting the working eccentric, and a running disk device encompassing the working eccentric, the tensioning tool comprising:

a gripping device, an engagement structure comprising a protruding pin connected to the gripping device by an articulated connection having an axis that extends perpendicular to a direction of longitudinal extent of the pin such that the gripping device can pivot relative to the engagement structure about the axis, the protruding pin configured to be coupled so that it is locked in rotation with the working eccentric from said front region facing away from said flange side of the eccentric tensioning device, and a decoupling structure connected to the gripping device for implementing an axial displacement of the working eccentric relative to the bearing journal, the decoupling structure including a hook section having an opening facing the pin and adapted to engage the running disk, and a pressure spindle extending in a same direction as the pin and located on the decoupling structure.

2. Tensioning tool according to claim 1, wherein the pin is constructed as a prism-shaped pin.

3. Tensioning tool according to claim 2, wherein the prism-shaped pin has a hexagonal cross section.

4. Tensioning tool according to claim 2, wherein the pin is arranged in an intermediate region between the pressure spindle and the hook section.

* * * * *